US005480038A

United States Patent [19]

Collier

[11] Patent Number: 5,480,038

[45] Date of Patent: Jan. 2, 1996

[54] TOOTHBRUSH HOLDER

[76] Inventor: Susan J. Collier, 2675 Arbor Springs Way, Marietta, Ga. 30066

[21] Appl. No.: 368,240

[22] Filed: Jan. 3, 1995

Related U.S. Application Data

[63] Continuation of Ser. No. 202,335, Feb. 25, 1994, abandoned.

[51] Int. Cl.[6] ..... A47F 7/00

[52] U.S. Cl. ..... 211/65; 211/87; D6/534; 248/110; 248/206.3

[58] Field of Search ..... 211/87, 65, 66; D6/528, 530, 534; 248/110, 111, 205.3, 206.3, 206.4

[56] References Cited

U.S. PATENT DOCUMENTS

| | | | |
|---|---|---|---|
| D. 157,947 | 4/1950 | Egerman | D6/534 |
| D. 163,391 | 5/1949 | Jason . | |
| D. 166,088 | 3/1952 | Lindsay . | |
| D. 172,060 | 4/1955 | Reich . | |
| D. 183,151 | 7/1958 | Varner & Zilem . | |
| D. 279,248 | 6/1985 | Oliver . | |
| 1,625,202 | 11/1924 | Gindick . | |
| 2,121,488 | 6/1938 | Nofz . | |
| 2,129,150 | 9/1938 | Pekrol . | |
| 2,572,697 | 10/1951 | Buckner | D6/530 X |
| 3,138,813 | 6/1962 | Kaplan . | |
| 3,170,265 | 5/1962 | Goldfarb . | |
| 3,867,096 | 2/1975 | Doucette . | |
| 3,881,868 | 5/1975 | Duke . | |
| 4,141,452 | 2/1979 | Martin et al. | 211/66 X |
| 4,978,003 | 12/1990 | Foster . | |

*Primary Examiner*—Robert W. Gibson, Jr.
*Attorney, Agent, or Firm*—Hardaway Law Firm

[57] ABSTRACT

A reversibly mounted holder for storing toothbrushes within a gap defined between a platform and an adjacent plate, the toothbrush being further attached to the holder by a coiled strap to prevent removal of the toothbrush from the immediate vicinity.

13 Claims, 2 Drawing Sheets

TOOTHBRUSH HOLDER

This application is a file wrapper continuation, of application Ser. No. 08/202,335, filed Feb. 25, 1994, abandoned.

BACKGROUND OF THE INVENTION

This invention is directed towards a toothbrush holder and is more particularly directed towards a holder to be used by children.

DESCRIPTION OF THE PRIOR ART

It is well known in the art to provide toothbrush holders. Such holders are of often cup-shaped and contain a plurality of openings through which the handle end of a toothbrush is retained. Horizontal racks are also well-known in which openings are provided for securing brushes. It is further known to provide ornamental features and designs to toothbrushes and the holders which cater to the imagination and intrigue of small children.

A problem with the above described types of holders and devices is that as designs are created to capture the imagination and attention of children, children begin regarding the products as toys. As a result, children will remove the brushes and or holders and use them as conventional toys. Therefore, parents often have to spend considerable time tracking down brushes and holders before their children's teeth can be cleaned. In addition, when children remove brushes and holders for playing, the sanitation and cleanliness of the brush is often compromised. As a result, it becomes difficult to establish a routine to develop good oral hygiene habits while at the same time maintaining toothbrushing as a fun activity for children.

SUMMARY OF THE INVENTION

It is an object of the invention to provide a toothbrush holder and brush combination which appeals to children.

It is a further and more particular object of this invention to provide a toothbrush holder in which the holder and the brush are resistant to removal by children.

It is still a further and more particular object of this invention to provide a toothbrush holder which provides an attached means for securing the brush without impairing the use of the brush.

These as well as other objects of the invention were provided by a toothbrush holder comprising: a platform having a front surface and a rear surface, the rear surface providing a mounting means for securing the platform to an upright; a first plate carried by the front surface of the platform, the plate and the platform defining a gap therebetween; a strap having a first end and a second end, the strap first end by means attached to the platform and the second end attached to a handle of a toothbrush; a retaining means for reversibly securing the toothbrush, the brush retaining means carried by one of the gap defining members; wherein when the toothbrush is connected to the strap, the toothbrush can be used in the vicinity of the holder, the retaining means permitting the toothbrush to be stored within the gap between uses.

DETAILED DESCRIPTION

Figure 1:
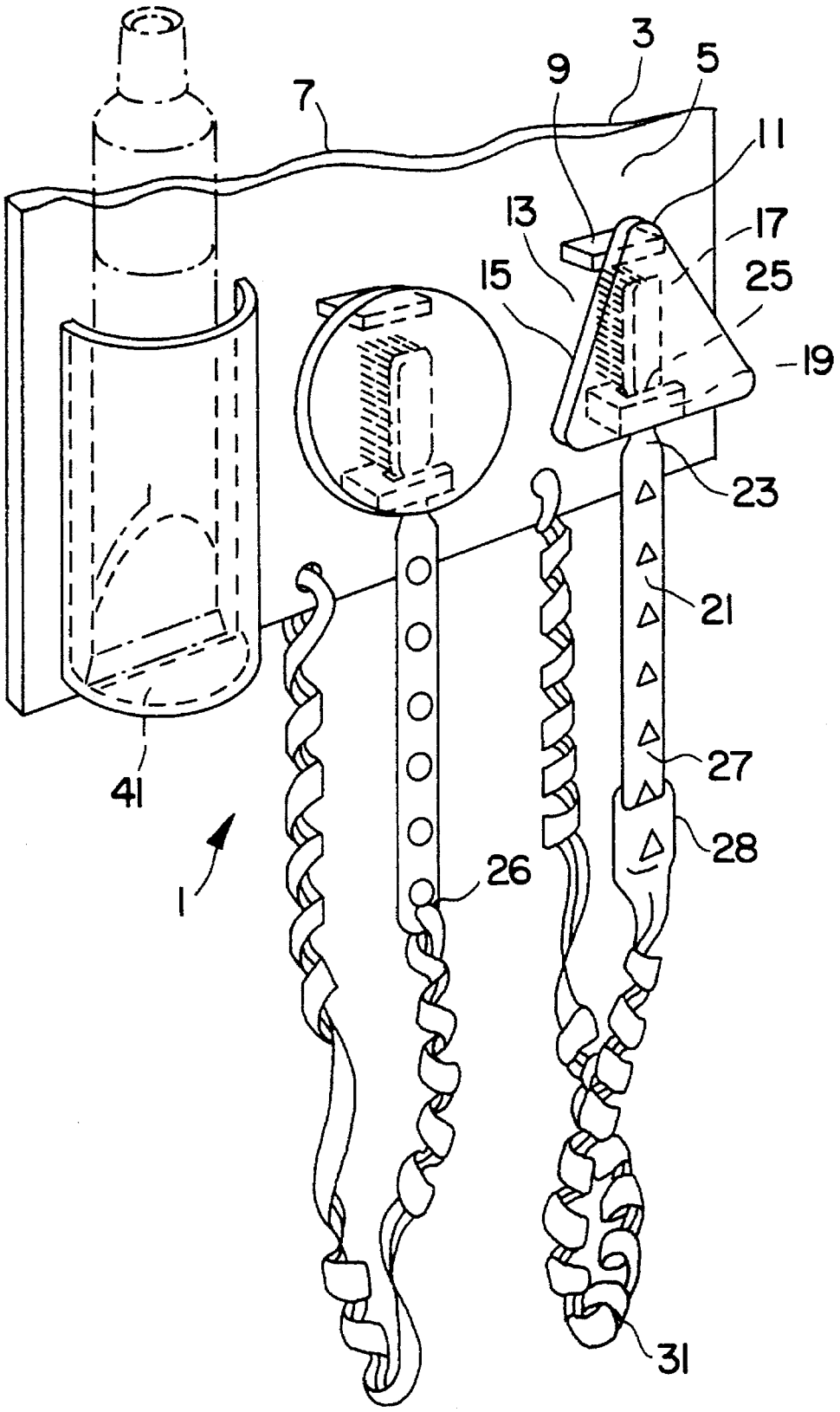
FIG. 1 is a perspective view of a preferred embodiment of the inventions.
Figure 2:
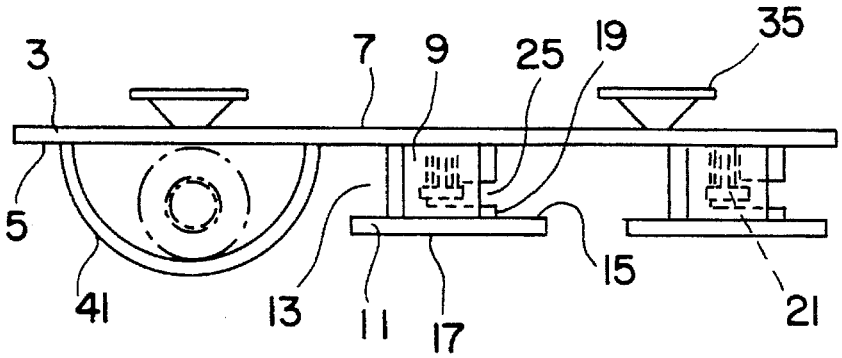
FIG. 2 is a top plan view thereof.
Figure 3:
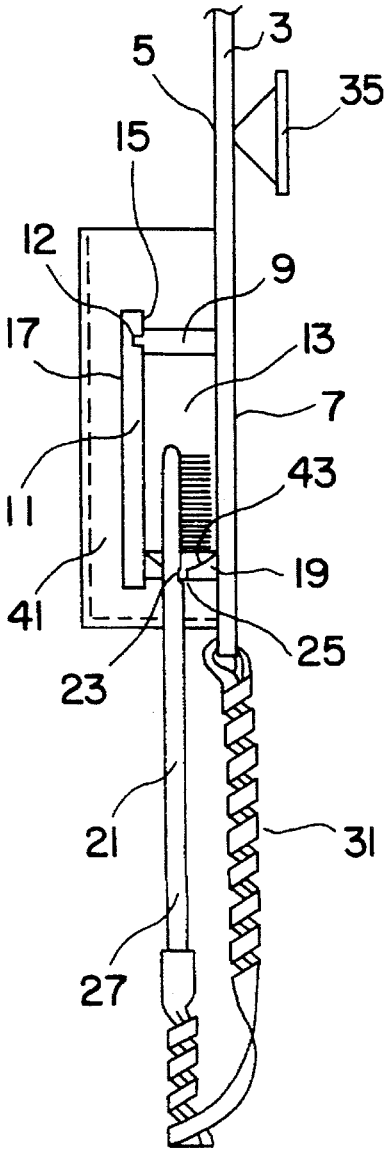
FIG. 3 is a side elevation view thereof.

In accordance with this invention, and as seen and described in reference to FIGS. 1 through 3, a preferred embodiment of a toothbrush holder apparatus 1 is provided which includes a platform 3 having a front surface 5, a rear surface 7, front surface 5 providing a spaced connector 9. Connector 9 is used attach a plate 11 attached to one end of connector 9. A gap 13 is defined between platform 3 and plate 11, the gap maintained by the spacing provided by connector 9.

An inner surface 15 of plate 11 has a groove 12 or other reversible friction fit type receptacle for engaging the appropriate end of connector 9. The connecting means can also be of a tongue and groove or other reversible attachment means such as a pin and socket, screw, or clamp. An outer surface 17 of plate 11 defines a distinct pattern, best seen in FIG. 1, as a circle and a triangle. However, the distinctive pattern can be in the form of other geometric designs, animals, or popular cartoon figures.

As seen in reference to FIGS. 2 and 3, gap 13 further defines a retaining means seen as clip 19 for holding a toothbrush 21 having a neck 23 which is inserted into a slot 25 of clip 19. As illustrated, clip 19 is carried by plate 11 and defines slot 25 so that brush 21 can be inserted from the side, brush 21 residing in the stored position so that the bristle tips project toward platform 3. However, a wide variety of alternative retaining means and orientations can be provided including having slot 25 being provided by connector 9 or having platform 3 carrying clip 19. Clip 19 could also be in the form of a friction fit enclosure. However, clip 19 and slot 25 is more versatile for use with replacement brushes whose dimensions may vary.

While the above description is given in reference to a single plate 11, it is understood that a plurality of plates 11, as seen in FIG. 1, can be provided, each plate similar to the reference plate described above. In embodiments where there are a plurality of plates, it is desired that each plate exterior provide a distinctive surface pattern to facilitate the recognition and replacement of the appropriate brush into the appropriate clip.

As seen in reference to a single plate 11 in FIG. 3, when toothbrush 21 is engaged by clip 19, the handle 27 of brush 21 extends from gap 13 and is substantially parallel to both the adjacent platform 3 and plate 11. The rear handle surface of brush 21 defines a pattern which is complementary to the pattern of plate 11 which assists a child in placing the brush in the proper slot when more than one plate 11 is provided. When multiple plates are provided, respective brushes can be installed from the same direction, as illustrated in FIG. 1, or from opposite directions if desired or need for better access.

At the base of brush 21, a retaining strap 31 is attached to brush handle 27. This strap can secure brush 21 through engaging an aperture defined within the brush handle or through an elastic sleeve which reversible engages the handle. A rubberized sleeve could be rolled and unrolled about the handle of the toothbrush to provide a reversible securing means of attaching the brush to an associated strap. The exterior of the sleeve can also define a complementary pattern to assist in recognition of replacement of the proper brush with the appropriate plate.

As seen in reference to FIG. 3, the opposite strap end is secured to platform 3. A portion of strap 31 is preferably a coiled loop to facilitate the use and movement of the brush in proximity to the holder without having excessive strap material to become entangled.

Platform 3 also provides attachment means for mounting the platform to a wall or mirror. A suction disk 35 is a preferred attachment means given its ease of installation, reversibility, as well as its ability to engage a mirrored or tiled surface without damage. However, well known screw mountings or brackets, as often used in conventional wall mounted bathroom accessories, will also suffice. As seen in reference to FIG. 1, a toothpaste tube holder 41 is also provided by front 5 of platform 3. Holder 41 is provided by a partial cylinder which is closed at the bottom, in which the tube of toothpaste can be stored in the cylinder interior.

Since toothbrushes are typically stored wet, the gap 13 between the platform and the plate provides air flow to help dry the brush bristles. A basin 43 is also provided for each brush, in association with slot 25 and clip 19, to collect and contain any fluid which might drain from the used brush as well as prevent unsightly stains from accumulating beneath the holder apparatus. Basin 43 can be a separate structure carried within the gap, or integrated into part of the clip 19.

The holder apparatus is preferably constructed of high impact resistant plastic or nylon. These materials are safe for use in the bathroom, are lightweight to facilitate preferred attachment means of a suction disk and can be provided in a variety of desired colors. Further, these materials are easily cleaned by hand or dishwasher and are amenable to well known interlocking, gripping, and attachment means referenced above for assembling the various component parts. While the platform, plates and various gap, clip, and basin components can be provided as a one piece unit, detachable and interlocking components facilitate cleaning and permit updating with new plate patterns to maintain the child's interest. The basin and clip components can also be provided wherein the components also fasten or otherwise attach to the plate 11 and thereby provide an additional securing and fastening means for attachment of the plate.

Strap 31 can be provided by a plastic coil which is directly glued, clipped, tied, or otherwise attached to platform 3. The coil portion of the strap is preferably a loose, open coil to minimize elastic recoil which would result from fully stretched cord being suddenly released. For similar safety reasons, the tensile strength of the strap should be sufficiently low so that the strap would break before any serious entanglement injury would occur.

It is thus seen that the above description and drawings provides a toothbrush holder which is suitable for children, is easily moved and equipped with updated designs, provides for replacement of brushes and discourages the removal of the brush and holder from their desired location. As numerous modifications of the preferred embodiment described above are possible to one having ordinary skill in the art upon reading the description, the scope of the present invention is hereby set forth by the following appended claims.

That which is claimed:

1. A toothbrush holder comprising:

a platform, said platform further comprising a mount for supporting said platform in an upright configuration;

at least one plate carried by said platform, said plate and said platform defining a gap therebetween;

a strap having a first end and a second end, said first strap end attached to said platform and said second end attached to a handle of a toothbrush;

a retainer for securing said toothbrush to said holder, said retainer positioned within said gap;

wherein when said toothbrush is connected to said strap said toothbrush can be used in vicinity of said holder, said retaining means permitting said toothbrush to be stored within said gap between uses.

2. The holder according to claim 1 wherein said mount is a suction disk.

3. The holder according to claim 1 wherein said mount is provided by a screw.

4. The holder according to claim 1 wherein said at least one plate comprises a plurality of plates, each said plate providing a respective gap and a respective brush retainer.

5. A toothbrush holder comprising:

a platform, said platform further comprising a mount for supporting said platform in an upright configuration;

a first plate carried by said platform, said first plate and said platform defining a first gap between said platform and said plate, said first plate defining a first pattern;

a second plate carried by said platform, said second plate and said second platform defining a second gap between said platform and said second plate, said second plate defining a second pattern;

a first strap and a second strap each said strap defining a first end and a second end, said first strap end attached to said platform and said second strap end attached to a respective first handle of a first toothbrush and a second handle of a second toothbrush;

a first retainer for securing said first brush to said platform, said first brush retainer positioned within said gap;

a second retainer for securing said second toothbrush to said platform, said second brush retainer positioned within said second gap;

wherein when said first and said second toothbrushes are connected to said respective straps, said toothbrushes can be used in the vicinity of said holder, said respective retaining means permitting said toothbrushes to be stored within said gap respective.

6. The holder according to claim 5 wherein said first strap and said second strap further define a respective first pattern and second pattern in conformity to said first plate pattern and said second plate pattern.

7. A toothbrush holder comprising:

a platform, having a front surface and a rear surface, said rear surface further providing a mounting means for securing said platform to an upright;

a first plate carried by said front surface of said platform, said plate and said platform defining a gap between said platform and said plate;

a strap having a first end and a second end, said first strap end by means attached to said platform and said second end attached to a handle of a toothbrush;

a slot, defined within said gap, for reversible housing said toothbrush;

wherein when said toothbrush is connected to said strap said toothbrush can be used in vicinity of said holder, said slot permitting said toothbrush to be stored within said gap between uses.

8. The toothbrush holder according to claim 7 wherein a basin is provided within said gap for retaining fluids from said brush.

9. The holder according to claim 8 wherein said first brush and said second brush further define a respective first pattern and second patter in conformity to said first and second patterns of said first plate and strap and said second plate and strap.

10. The holder according to claim 1, wherein said platform has front and rear surfaces, said rear surface having said mount, and said mount is for securing said platform to an upright.

11. The holder according to claim 10, wherein said plate is carried on said front surface of said platform.

12. The holder according to claim 1, wherein said retainer is configured to allow said toothbrush to be reversibly secured to said retainer.

13. A toothbrush holder comprising:

a platform;

a tooth brush retainer attached to said platform; and

* * * * *